United States Patent [19]

Giles

[11] 4,252,543

[45] Feb. 24, 1981

[54] PROCESS FOR QUENCHING AND CLEANING A FUEL GAS MIXTURE

[75] Inventor: Walter B. Giles, Scotia, N.Y.

[73] Assignee: General Electric Company, Schenectady, N.Y.

[21] Appl. No.: 60,587

[22] Filed: Jul. 25, 1979

[51] Int. Cl.[3] ..... C10K 1/06

[52] U.S. Cl. ..... 48/197 R; 48/210; 55/89

[58] Field of Search ..... 48/197 R, 202, 206, 48/210; 55/80, 85, 89; 208/48 B

[56] References Cited

U.S. PATENT DOCUMENTS

| | | | |
|---|---|---|---|
| 3,811,849 | 5/1974 | Woodmansee | 48/202 |
| 4,031,030 | 6/1977 | Rudolph | 48/206 |
| 4,089,659 | 5/1978 | Baron et al. | 48/197 R |
| 4,123,502 | 10/1978 | Holter et al. | 48/197 R |
| 4,150,953 | 4/1979 | Woodmansee | 48/197 R |

FOREIGN PATENT DOCUMENTS

| | | | |
|---|---|---|---|
| 2416583 | 11/1975 | Fed. Rep. of Germany | 55/85 |

*Primary Examiner*—Peter F. Kratz

*Attorney, Agent, or Firm*—Robert R. Schroeder; James C. Davis, Jr.; Paul R. Webb, II

[57] ABSTRACT

A process is described for both (i) quenching a fuel gas mixture including at least one gaseous hydrocarbon foulant (described more particularly herein) and (ii) removing at least a portion of the foulant without substantial formation of mist thereof in the gas mixture. The process includes contacting a flow of the gas mixture with a liquid jet spray of large droplets of a coolant mixture comprising liquid water and viscous liquid hydrocarbon. The contact is maintained for a sufficient period of time such that at least a portion of the foulant is liquefied and collected on the droplets. The droplets having foulant thus deposited thereon are removed from the treated gas mixture in a separation zone.

7 Claims, 1 Drawing Figure

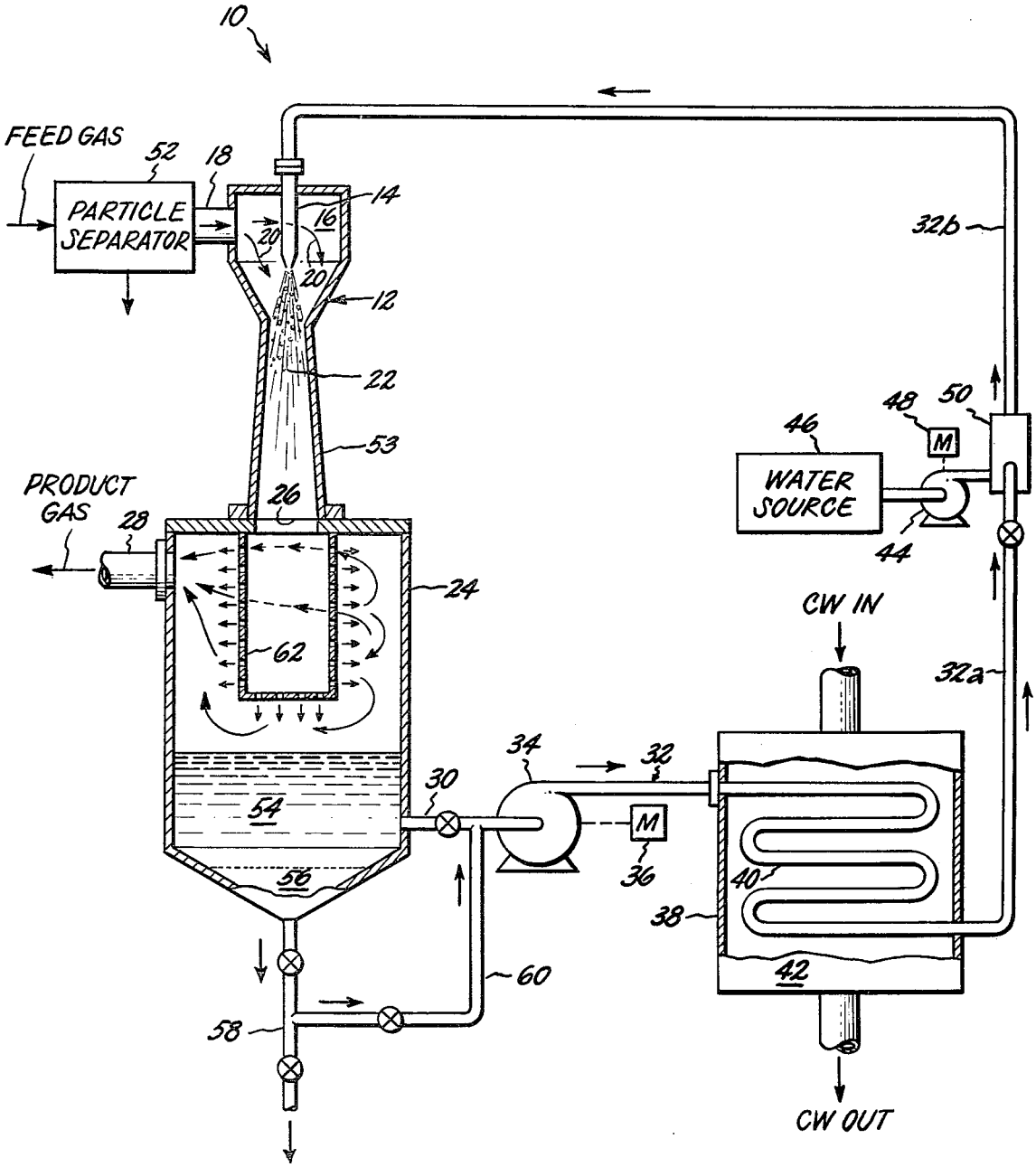
10
FEED GAS
52
18
PARTICLE SEPARATOR
14
16
20
20
12
22
53
26
PRODUCT GAS
28
24
62
54
56
30
34
32
M
36
40
38
42
60
58
32b
48
50
46
M
WATER SOURCE
44
CW IN
32a
CW OUT

PROCESS FOR QUENCHING AND CLEANING A FUEL GAS MIXTURE

BACKGROUND OF THE INVENTION

This invention relates to a process and apparatus for both (i) quenching a fuel gas mixture including at least one gaseous hydrocarbonaceous foulant (described more particularly hereinbelow) and (ii) removing at least a portion of the foulant without substantial formation of mist thereof in the fuel gas mixture. The invention is especially applicable to treating raw gaseous fuel produced by pressure gasification of coal in a fixed-bed gasifier.

Fixed-bed gasifiers and methods for pressure gasification of coal are described in Woodmansee in U.S. Pat. Nos. 3,811,849 and 4,150,953, which are incorporated herein by reference. The latter patent additionally illustrates a gas clean-up system wherein, as described in the patent," an oily aqueous blowdown liquid or condensate body 118 [in a vessel referred to as a "gas quench unit"] comprising a mixture of water, oil, tar and volatile hydrocarbons is drawn off . . . for recirculation of the quenching liquid . . . to sprayhead 124 [within the gas quench unit]." (col. 7 at lines 7–14). As further described in that patent: "In the quench unit, the sprayed aqueous liquid may be at a temperature of, for example, 330° F., resulting in condensation from the gas of condensible hydrocarbons including tar and volatile hydrocarbons. The resulting oily aqueous blowdown liquid 118 collected in the quench unit contains condensed volatile hydrocarbons and other contaminants removed from the raw gas." (See col. 3 at lines 20–27.)

However, there remains a substantial need in the art for a process and apparatus capable of both quenching a fuel gas mixture including at least one gaseous hydrocarbonaceous foulant (e.g., hydrocarbon oil) and removing at least a portion of the foulant without substantial formation of mist thereof in the gas mixture.

It has now been found, by practice of the present invention, that such need is substantially fulfilled.

The invention is eminently suitable for quenching and clean-up of sulfur-bearing raw fuel gas, such as that produced in pressurized gasification of medium-to-high sulfur coal (as taught, for example, in the above-cited U.S. Pat. No. 4,150,953), to produce treated fuel gas which has such quality and temperature (e.g., 200° F.) that it can be directly introduced into a hot potassium carbonate absorption system for removal of the sulfur as $H_2S$. That is, no further treatment of the gas is required, thereby omitting the need for such additional prior art steps as washing (whereby foulant mist is removed), further cooling, etc., and requisite apparatus therefor.

DESCRIPTION OF THE INVENTION

Generally stated, in one aspect of this invention, a process is provided for both (i) quenching a fuel gas mixture including at least one gaseous hydrocarbonaceous foulant which is (a) highly viscous in the liquid state, (b) higher boiling than water at the operating pressure in the zone wherein quenching is effected, and (c) a mist-former upon rapid cooling of the mixture with a coolant selected from the group consisting of water and an aqueous liquid comprising oily hydrocarbon and water in an amount substantially in excess of that amount of water vaporized from the coolant during such rapid cooling and (ii) removing from the fuel gas mixture at least a portion of said hydrocarbonaceous foulant without substantial formation of mist thereof in the fuel gas mixture.

The process comprises the steps of:

(a) contacting a flow of the gas mixture with a liquid jet spray of large droplets of a coolant mixture comprising liquid water and viscous liquid hydrocarbon. The temperature of said large droplets at the beginning of said contacting step is less than the lowest temperature at which said hydrocarbonaceous foulant vaporizes at the operating pressure in the zone wherein said contacting step is effected. The water is present in said coolant mixture at said beginning in a sufficiently low amount such that a substantial portion of the water will vaporize during a continued contact of said gas mixture with said coolant mixture, said continued contact being for a period of time sufficient to effect transfer of the resulting water vapor into admixture with said fuel gas mixture with the remaining droplets being substantially free of water. Also included is a step of maintaining the contact for said period of time such that at least a portion of said hydrocarbon foulant is liquefied and collected on said remaining droplets. Further included is a step of removing the remaining droplets having hydrocarbon foulant deposited thereon from the treated fuel gas mixture in a gravitational separation zone.

Generally stated, in another aspect of this invention, a system useful for performing the process thereof is provided. The system or apparatus comprises a substantially venturishaped mixer having a jet spray nozzle extending axially into an inlet region thereof. The mixer additionally has means for introducing a flow of the gaseous mixture circumferentially about said nozzle to form a spiral flow of said mixture with a flow velocity component which is coaxial with said nozzle, said spiral flow being axially co-directional with the nozzle spray and of lower velocity than that of said spray. The system also includes a separating chamber in flow communication with an outlet of said venturi-shaped mixer for receiving a downward output flow therefrom, said chamber having means for conducting a flow of clean gas from an upper portion thereof and means for conducting from a lower portion thereof a flow of foulant-including liquid collected therein. The system further includes a fluid flow circuit communicating at one end thereof with the last-mentioned conducting means and communicating at the other end of the circuit with the inlet of said nozzle. The fluid-flow circuit includes means for pumping said foulant-including liquid through cooling means for cooling said flow, means for introducing water into said liquid, means for mixing the cooled flow with water introduced therein, and means for conducting a flow of the resulting aqueous mixture to the inlet of said nozzle.

BRIEF DESCRIPTION OF THE DRAWING

This invention will be better understood from the following detailed description taken with the accompanying drawing wherein the best mode contemplated for carrying out the invention is illustrated. In the drawing, there is shown a flow sheet schematically illustrating the process and system of this invention.

Detailed Description of the Invention and Manner and Process of Making and Using It Referring now to the drawing, there is shown system useful for performing the process of this invention. The system or apparatus comprises a substantially venturishaped mixer 12 having a jet spray nozzle 14 extending axially into inlet region 16 thereof. The mixer additionally has gas-inlet conduit 18 in tangential flow communication with the inlet region, the conduit serving as a means for introducing a flow of the gaseous mixture circumferentially about the nozzle to form a spiral form (indicated by arrows 20) of the mixture with a flow velocity component which is coaxial with the nozzle, the spiral flow being axially co-directional with the nozzle spray 22 and of lower velocity than that of said spray.

The system also includes separating chamber 24 in flow communication with outlet 26 of the venturi-shaped mixer for receiving a downward output flow therefrom. The chamber has gas outlet conduit 28 in flow communication therewith. The outlet conduit serves as a means for conducting a flow of clean gas from an upper portion thereof. The separation chamber is further provided with liquid-outlet conduit 30 in flow communication therewith, the last-mentioned conduit serving as a means for conducting, from a lower portion of the chamber, a flow of foulant-including liquid collected therein.

The system further includes fluid flow circuit 32 communicating (i.e., in direct flow communication) at one end thereof with the separation chamber via the liquid outlet conduit 30 and communicating at the other end of the circuit with the inlet of the nozzle 14. The fluid-flow circuit includes pump 34 driven by motor 36 operably connected thereto for pumping the foulant-including liquid through cooling device or heat exchanger 38 provided for cooling said flow, as by conducting a flow of cold water (identified as "CW" in the drawing) in contact with the outer surface of heat exchange coil 40 through which the foulant-including liquid is pumped. (The coil is shown in full view as a result of showing the exchanger wall 42 in fragmentary view.)

Also included in the fluid-flow circuit, preferably downstream (as shown) from the heat exchanger, is pump 44 in flow communication via the inlet end thereof with water source 46. The pump, which may be driven by motor 48 operably connected thereto, is in flow communication via the outlet end thereof with the foulant-including liquid being pumped through the circuit, whereby the pump serves to introduce water into the liquid. Flow communication of the pump 44 with the foulant-including liquid is preferably (as shown) via in-line mixer 50. Leg 32*a* of the fluid-flow conduit constituting a portion of the circuit is in direct flow communication with an inlet of the in-line mixer, while leg 32*b* of the circuit flow conduit is in direct flow communication with an outlet of the in-line mixer, which serves to mix the cooled flow of foulant-including liquid with the water introduced therein via the pump 44. The flow-conduit leg 32*b* conducts the aqueous mixture resulting from the mixing action of the in-line mixer to the inlet of the nozzle 14.

In operation of the system, a flow of fuel gas mixture or feed gas including at least one gaseous hydrocarbonaceous foulant having the properties set forth in the above first paragraph under the heading "Description of the Invention" is introduced, preferably continuously, via the conduit 18 into the inlet region 16 of the substantially venturi-shaped mixer 12. For simplicity, the latter mixer is referred to as the "venturimixer". The foulant can be, for example, a hydrocarbon oil having the last-mentioned properties. For best results, feed gas containing solid particulate matter is first passed through optionally included particle separator 52, which may be for example a cyclone separator, for removal of at least a substantial portion of the solid particulates. The feed gas entering the venturi mixer can be almost any gas containing a foulant as described above, for which it is desired to quench the gas and remove at least a portion of the foulant.

A coolant mixture comprising liquid water and viscous liquid hydrocarbon is introduced into the venturi mixer via nozzle 14 concurrently with the introduction of the feed gas. The nozzle is selected such that the droplets of coolant mixture constituting the resulting jet spray 22 are large. In general, the average largest dimension of the droplets may be, for example, at least 20 microns, preferably from about 30 to about 100 or more microns. The viscous liquid hydrocarbon may be (and preferably is) of substantially the same chemical composition as the foulant. The temperature of the feed gas entering the venturi mixer may be any suitable elevated temperature, e.g. from about 500° F. or less to about 2000° F. or more.

The feed gas is preferably admitted tangentially to initially form the above-described spiral flow oriented coaxially of the nozzle and co-directional with the nozzle spray. The coolant mixture is preferably supplied at a sufficiently high-pressure such that the velocity of the spiral gas flow is lower than the velocity of the coolant-mixture spray 22. The above-described flow conditions provide the best mode contemplated for the resulting step of contacting the gas mixture flow with the liquid jet spray of coolant mixture.

The coolant mixture is supplied to the inlet of the nozzle at a sufficiently low temperature such that the temperature of the coolant mixture droplets emanating from the nozzle (i.e., at the beginning of the contacting step) is less than (e.g. at least 50° F. below and preferably at least 100° F. below) the lowest temperature at which the foulant vaporizes at the operating pressure in the venturi mixer. (Such pressure may be, for example, from about 1 psia or less to about 1000 psia or more.)

The water is included in the introduced coolant mixture in a sufficiently low amount such that a substantial portion of the water vaporizes during a continued contact of the gas mixture with the coolant mixture. Such continued or maintained contact is for a time sufficient to effect transfer of the resulting water vapor into admixture with the fuel gas mixture being quenched, with the remaining droplets being substantially free of water. For a given size venturi-mixer, the flow rate of the feed gas and coolant mixture can be readily adjusted to provide the requisite contact time. Increasing the size of the venturi mixer portion 53 will increase the contact time for a given flow rate of feed gas. By so maintaining the contact, at least a portion of the foulant is liquified and collected on the remaining or residual droplets, which (as indicated above) are substantially free of water in accordance with this invention.

The remaining droplets having liquefied foulant collected or deposited thereon from the treated fuel gas and the resulting admixture of such gas with the vaporized water are passed into the separation chamber 24 via venturi-mixer outlet 26. Therein the remaining droplets having the foulant deposited thereon are separated from the mixture of treated fuel gas with vaporized water by the action of gravity. The separation results in formation in the chamber of liquid body 54 from the latter-mentioned droplets.

The fuel gas may include one or more additional foulants, e.g. hydrocarbon tar which is less volatile than the hydrocarbon oil foulant. In such case, maintenance of the requisite contact time for removing at least a portion of the oil foulant serves also to remove at least a portion of the less volatile tar. In such cases, as well as the case where the only foulant present and being removed is oil, contact is preferably maintained for a sufficiently long time such that at least a substantial portion of each foulant is liquefied and collected on the residual droplets of viscous liquid hydrocarbon.

The coolant mixture temperature at the beginning of the contacting step is preferably sufficiently lower than the lowest boiling temperature of the at least one gaseous hydrocarbon foulant such that a substantial portion of each such foulant is liquefied, collected on the substantially water-free residual droplets, and removed from the treated gas. Such sufficiently low temperature is typically at least 100° F. lower than the lowest foulant boiling temperature at the pressure employed in the contacting zone.

In a preferred embodiment of the process, the spray droplets are formed by initially recovering the body 54 formed of droplets removed in the separation zone. Thereafter, the body is cooled as by passing it through heat exchanger 38 via pump 34, thereby subjecting it to the cooling action of cooling water or other suitable coolant. The recovered body is cooled preferably to a sufficiently low temperature such that, after subsequently mixing the cooled flow of the body with water (as in in-line mixer 50) as described above and with the abovedescribed amount of water employed, the resulting foulant-water mixture is at a temperature at least 50° F. below the temperature of the treated fuel gas mixture exiting the chamger via conduit 28. The exiting gas temperature will normally be approximately the same as that of the liquid body 54 in the chamber. Thereafter, the cool mixture of coolant is conducted via leg **32*b*** of the fluid-flow circuit to the inlet of nozzle, in which the droplets being introduced into the venturi-mixer are formed.

As indicated above, the present invention is especially applicable to quenching and cleaning raw gaseous fuel produced by pressure gasification of coal (as in a fixed-bed gasifier). The fuel gas introduced into the venturi-mixer may be at any suitable temperature, e.g. from about 800° F. to about 1100° F. Such raw gaseous fuel typically contains as foulant(s), one or more hydrocarbon oils having the above-described properties. The foulant boiling point (or lower end of the boiling range where more than one such oil foulant is present in the gas) is typically about 600° F. For such conditions, the spray-forming coolant mixture is preferably supplied at a nozzle-inlet temperature of about 200° F. or less.

A typical set of operating conditions is set forth below for a fuel gas mixture of the last-mentioned type:

Feed gas flow rate: 2 lb/sec at 900° F. and 20 std. atmospheres pressure

Foulant (included): 100 lb/hr of tar and oil. Approximate condensing temperature—450° F.

Coolant Mixture: 16 gal/min of water and 10.8 gal/-min of recovered foulant, 200° F., 120 psi drop through nozzle, 30-micron droplet diameter Liquid-to-gas ratio: 800 gpm/1000 cfm % Water evaporated: substantially 100%

Exiting Gas Temperature: 300° F.

Where both oil and tar foulants are removed from the feed gas, the relatively higher density tar settles to the lower part of the chamber 24 to form tar body 56. Drain line 58 provided in flow communication with the bottom of the chamber is employed to drain off the tar, with the pump 34 drawing off the lower density oil from above the tar body. It may be undesirable to include any significant amount of tar in the coolant mixture due the greater plugging tendency of tar. However, if desired, an amount of tar may be included in the coolant mixture as by opening the valve in the fluid conduit 60 and the valve nearer the chamber in the drain line 58, whereby the pump 34 draws tar therethrough in addition to the oil drawn by the pump via conduit 30. With the lower valve in the drain line open, collected foulant can be drained from the chamber as desired, as e.g. to maintain a substantially constant level of the liquid body in the chamber.

Screen 62 may be provided in the chamber coaxially of the chamber entrance to aid in precluding mist entrainment in the treated gas exiting the chamber via conduit 28, which entrainment could result from inadvertent and momentary failure of elements of the system, e.g. such failure of pump 84.

The components of the system can be obtained from commercial sources and assembled using well-known assembling methods.

BEST MODE CONTEMPLATED

The best mode contemplated for carrying out this invention has been set forth in the description above, for example by way of setting forth preferred structural arrangements, compositions and operating conditions, including but not limited to preferred ranges and values of amounts, temperatures, pressures, and other unobvious variables material to successfully practicing (including making and using) the invention in the best way contemplated at the time of executing this patent application.

It is understood that the foregoing detailed description is given merely by way of illustration and that many modifications may be made therein without departing from the spirit or scope of the present invention.

What is claimed is:

1. A process for both (i) quenching a fuel gas mixture including at least one gaseous hydrocarbonaceous foulant which is (a) highly viscous in the liquid state, (b) higher boiling than water at the operating pressure in the zone wherein quenching is effected, and (c) a mist-former upon rapid cooling of the mixture, and (ii) removing from the fuel gas mixture at least a portion of said hydrocarbonaceous foulant without substantial formation of mist thereof in the fuel gas mixture, said process comprising the steps of:

(a) contacting a flow of the gas mixture with a liquid jet spray of large droplets of a coolant mixture comprising liquid water and viscous liquid hydrocarbon, the temperature of said large droplets at the beginning of said contacting step being sufficiently lower than the lowest temperature at which said hydrocarbonaceous foulant vaporizes at the operating pressure in the zone wherein said contacting step is effected so as to enable the liquefication of a substantial portion of said foulant, the water being present in said coolant mixture at said beginning in a sufficiently low amount such that a substantial portion of the water will vaporize during a continued contact of said gas mixture with said coolant mixture, said continued contact being for a period of time sufficient to effect transfer of the resulting water vapor into admixture with said fuel gas mixture with the remaining droplets being substantially free of water, and (b) maintaining the contact for said period of time such that a substantial portion of said hydrocarbon foulant is liquefied and collected on said remaining droplets, and (c) removing said remaining droplets having hydrocarbon foulant deposited thereon from the treated fuel gas mixture in a gravitational separation zone.

2. The process of claim 1 wherein the average largest dimension of said large droplets is at least about 20 microns.

3. The process of claim 2 wherein said average largest dimension is from about 30 to about 100 microns.

4. The process of claim 1 wherein said foulant is hydrocarbonaceous oil.

5. The process of claim 4 wherein said fuel gas mixture includes hydrocarbonaceous tar as an additional foulant, said tar being less volatile than said oil, and said contact-maintaining step being for a sufficient time such that at least a substantial portion of each of the foulants is liquefied and collected on said remaining droplets.

6. The process of claim 1, wherein said droplets are formed by recovering a body of the droplets removed in step c, cooling said body and mixing it with water such that a cool mixture of said foulant and water is formed, the foulant-water mixture being at a temperature at least 50° F. below the temperature of said treated fuel gas mixture, and forming said droplets of said coolant mixture from said cool mixture.

7. The process of claim 1, wherein said fuel gas mixture is raw gaseous fuel produced by pressure gasification of coal in a fixed bed gasifier, said fuel being at a temperature of from about 800° F. to about 1100° F. at said beginning, said foulant being one or more hydrocarbonaceous oils with a boiling point or lower end of boiling range of about 600° F., and said droplets being at a temperature of about 200° F.

* * * * *